US005437111A

United States Patent [19]

Kousaka et al.

[11] Patent Number: 5,437,111

[45] Date of Patent: Aug. 1, 1995

[54] ELEVATING SHOE PROVIDED WITH A DECEPTIVE INNER MEMBER

[75] Inventors: Sachiko Kousaka; Mitsuko Kousaka, both of Sakai; Kumiko Isaka, Izumi, all of Japan

[73] Assignee: Yuugen Kaisha Frontier, Osaka, Japan

[21] Appl. No.: 305,501

[22] Filed: Sep. 13, 1994

Related U.S. Application Data

[63] Continuation of Ser. No. 28,679, Mar. 10, 1993, abandoned.

[30] Foreign Application Priority Data

| | | | |
|---|---|---|---|
| Mar. 13, 1992 | [JP] | Japan | 4-89871 |
| Mar. 23, 1992 | [JP] | Japan | 4-95898 |
| Apr. 4, 1992 | [JP] | Japan | 4-112279 |
| Apr. 8, 1992 | [JP] | Japan | 4-116887 |
| Apr. 20, 1992 | [JP] | Japan | 4-126872 |
| Aug. 11, 1992 | [JP] | Japan | 4-236477 |
| Jan. 22, 1993 | [JP] | Japan | 5-272693 |

[51] Int. Cl.[6] ..... A43B 13/38

[52] U.S. Cl. ..... 36/81; 36/34 R; 36/71; 36/178; 36/43

[58] Field of Search ..... 36/34 R, 71, 81, 92, 36/97, 37, 43, 173, 43, 44, 173–180, 35 R

[56] References Cited

U.S. PATENT DOCUMENTS

| | | | |
|---|---|---|---|
| 1,585,856 | 5/1926 | Headley . | |
| 1,890,910 | 12/1932 | Marshall | 36/44 |
| 1,977,695 | 6/1933 | Pinaud . | |
| 2,016,215 | 10/1935 | Pietzuch | 36/35 R |
| 2,181,110 | 11/1939 | Esser | 36/35 R |
| 2,200,493 | 5/1940 | Ehrich | 36/81 |
| 2,205,753 | 6/1940 | Svrlinga, Jr. | 36/81 |
| 2,212,414 | 8/1940 | Burger . | |
| 2,433,329 | 12/1947 | Adler et al. | 36/81 |
| 2,629,189 | 2/1953 | Stein | 36/35 R |
| 2,700,230 | 1/1955 | Beyer | 36/81 |
| 2,865,097 | 12/1958 | Vollrath, Jr. . | |
| 3,124,887 | 3/1964 | Vassar | 36/81 |
| 3,984,926 | 10/1976 | Calderon | 36/71 |
| 4,224,749 | 9/1980 | Diaz-Cano | 36/35 R |
| 4,442,612 | 4/1984 | Hauser | 36/43 |
| 4,517,981 | 5/1985 | Santopietro et al. | 36/43 |
| 4,523,395 | 6/1985 | Borsoi . | |
| 4,530,173 | 7/1985 | Jesinsky, Jr. | 36/81 |
| 4,862,604 | 9/1989 | Houser | 36/71 |
| 4,882,856 | 11/1989 | Glancy | 36/43 |
| 4,910,885 | 3/1990 | Hsieh . | |

FOREIGN PATENT DOCUMENTS

| | | | |
|---|---|---|---|
| 381635 | 7/1940 | Italy | 36/71 |
| 447194 | 5/1936 | United Kingdom | 36/81 |

*Primary Examiner*—David T. Fidei
*Assistant Examiner*—Marie D. Patterson
*Attorney, Agent, or Firm*—Jordan and Hamburg

[57] ABSTRACT

An elevating shoe includes a shoe body having an upper, a sole, a heel, an inner member provided in the shoe body for raising the height of the wearer. The inner member includes an elevating portion formed with a top portion defined by a minimum area necessary to support the heel bone of the wearer, a forward slope portion, and a rearward slope portion, the forward and rearward slope portions being positioned between a peripheral edge of the elevating portion and the top portion, and extending from the peripheral edge of the elevating portion to the top portion with a substantially continuous gradient which rises toward the top portion, and being connected to the top portion with an identical color to one another. The third person is hard to perceive the provision of the deceptive inner member.

24 Claims, 3 Drawing Sheets

ELEVATING SHOE PROVIDED WITH A DECEPTIVE INNER MEMBER

This application is a continuation of application Ser. No. 08/028,679 filed Mar. 10, 1993, now abandoned.

BACKGROUND OF THE INVENTION

1. Field of the Invention

The present invention relates to elevating shoes and, more particularly to elevating shoes which deceptively give appearance that the wearer is tall.

2. Prior Art

Conventionally, elevating shoes have been known which give the appearance that the wearer is tall by means of a high sole or a high heel. However, people are reluctant to put on such elevating shoes, particularly men, because they feel ashamed of putting on such elevating shoes.

Accordingly, various deceptive elevating shoes have been proposed which raises the height of the wearer without being perceived by the third person.

One of such deceptive shoes is disclosed in the Japanese Unexamined Utility Model Publication No. 3-112001. This publication discloses a deceptive elevating shoe which is provided with an inner member having an elevating portion to elevate the tibia bone of the wearer. However, this conventional elevating shoe has been insufficient to satisfy the demand of the wearer.

Also, it has been known that elevating shoes provided with such an inner elevating member involve uncomfortable and uneasy walking due to the elevation of the tibia bone. Accordingly, there has been greatly demanded elevating shoes which can assure comfortable and easy walking albeit being provided with an inner elevating member.

It is an object of the present invention to provide a deceptive elevating shoe which can keep a deceptive elevating structure from being perceived by the third person even when being taken off, and can assure comfortable and easy walking.

SUMMARY OF THE INVENTION

Accordingly, the present invention is directed to an elevating shoe comprising a shoe body having an upper, a sole, and a heel; an inner member provided in the shoe body for raising the height of the wearer, the inner member including an elevating portion formed with: a top portion being defined by a minimum area necessary to support the heel bone of the wearer; a forward slope portion; and rearward slope portion; the forward and rearward slope portions being positioned between a peripheral edge of the elevating portion and the top portion, and extending from the peripheral edge of the elevating portion to the top portion with a substantially continuous gradient which rises toward the top portion, and being connected to the top portion with an identical color to one another.

With thus constructed elevating shoe, the top portion is connected to the forward and rearward slope portions with a substantially continuous gradient and with the identical color. Accordingly, the third person can be given the deceptive appearance that the surface of the inner member is flat. Also, the top portion is defined by a minimum area necessary to support the heel bone of the wearer. Consequently, the respective peripheral edges of the forward and rearward slope portions can be positioned lower at smaller inclination angles. This permits the third person to see greater areas of the upper, and to perceive the depth of the upper is great, in other words, the height of the inner member is small. Accordingly, this construction makes the third person perceive the deceptive appearance that no inner elevating member is provided within the shoe owing to the combination of the deceptive flat effect and the deceptive deep effect.

The inner member may be made of an insert member placed over the sole, and an deceptive elevating member placed on the insert member. Also, the inner member may be formed by an integrated one body. Further, the top portion may be formed into a semicircle, and the rearward slope portion may be formed with a hemiconical surface. Further, the forward and rearward slope portions may be formed with a substantially straight surface. Furthermore, a thin contrasting line may be provided near a boundary between the peripheral edges of the inner member and an inner surface of the upper. Moreover, the peripheral edge of the rearward slope portion is formed so as to descend in a rearward direction. These construction can provide easier production of the inner member, and enhance the deceptive effects.

Further, it may be preferable that the heel is made of a heel body for supporting the wearer, the heel body having a rear bottom end spaced apart from the axis of the tibia bone by a distance for assuring comfortable walking; and a heel configuration forming member provided behind the heel body for forming a desired heel configuration, the heel configuration forming member being made of a resilient material.

With thus constructed elevating shoe, the heel is provided with the heel body having the rear bottom end spaced apart from the axis of the tibia bone by the comfortable walking distance. Accordingly, this shoe can give easy and comfortable walking to the wearer.

These and other objects, features and advantages of the present invention will become more apparent upon a reading of the following detailed description and drawings.

DESCRIPTION OF PREFERRED EMBODIMENTS OF THE INVENTION

Figure 1:
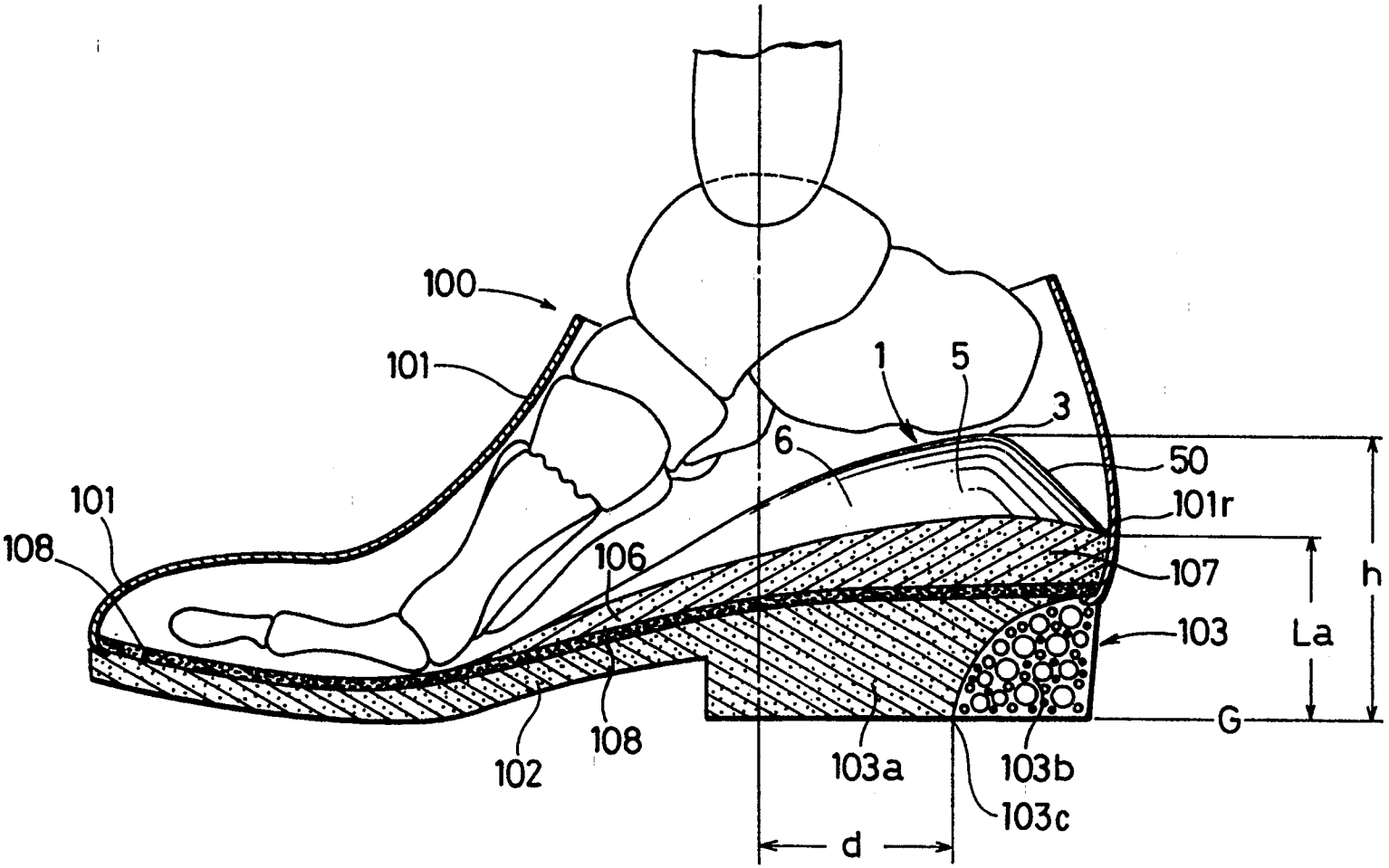
FIG. 1 is a cross sectional view showing an elevating shoe embodying the present invention, a deceptive elevating member being not sectioned.
Figure 2:
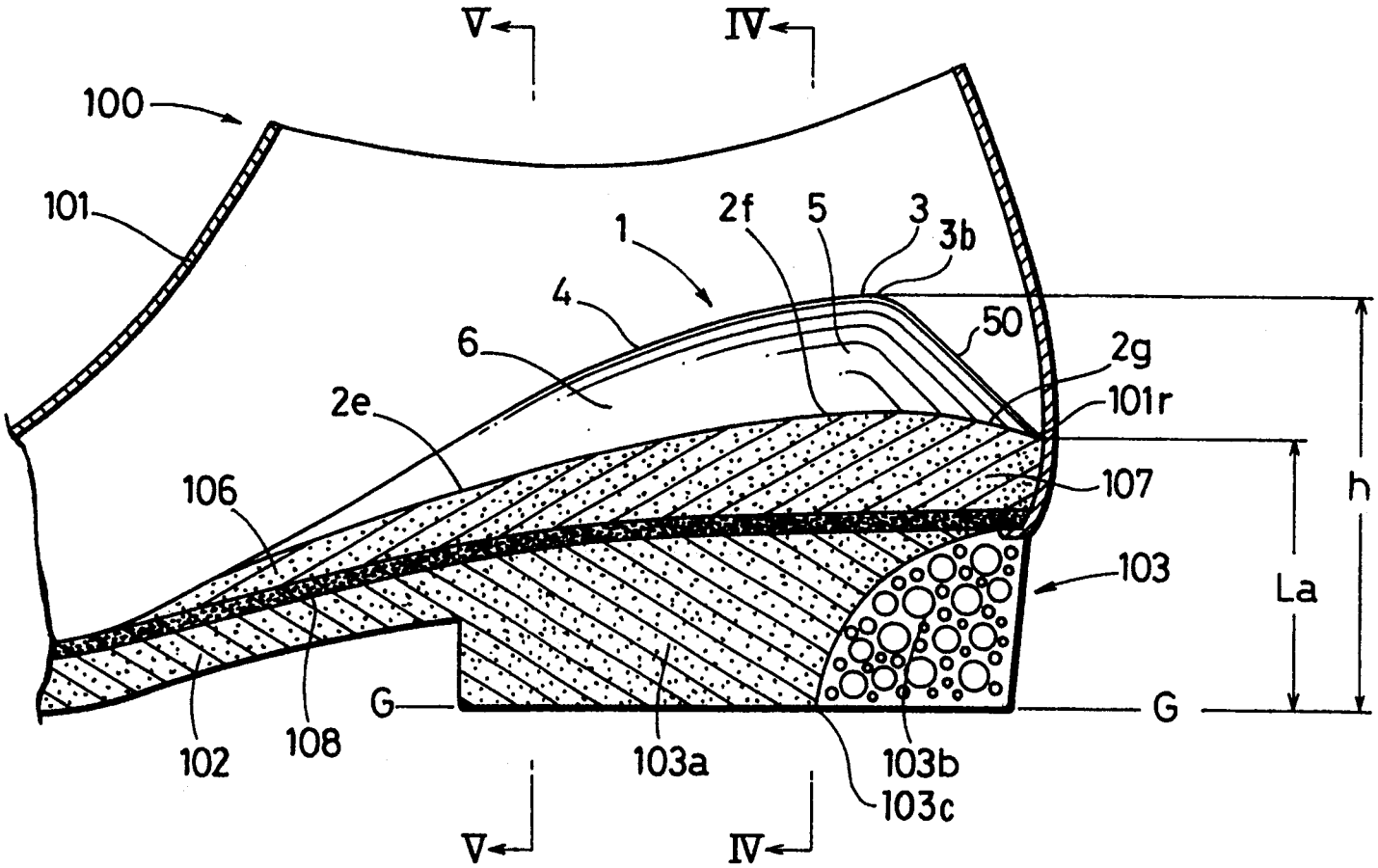
FIG. 2 is an enlarged sectional view showing a main portion of the elevating shoe, the deceptive elevating member being not sectioned.

FIG. 1 is a cross sectional view showing an overall construction of an elevating shoe in accordance with the present invention. FIG. 2 is an enlarged view in section showing the elevating shoe with a forward portion thereof omitted. The elevating shoe includes an upper 101, an outer sole 102, inner sole 108, insert member 106, and a deceptive elevating member 1. The outer sole 102 has a heel portion 103 in a rearward portion thereof as described later. The insert 106 and the deceptive elevating member 1 combinedly constitute an inner elevating member. The upper 101 wraps the periphery of the inner sole 108, and extends upward. The outer sole 102 is attached to the underside surface of the inner sole 108.

The heel portion 103 includes a heel body 103*a* and a heel configuration forming member 103*b*. The heel body 103*a* is disposed in a forward portion of the heel portion 103 and made of a relatively firm material. The heel configuration forming member 103*b* is disposed in a rearward portion of the heel portion 103 and made of a resilient material. In other words, the heel configuration forming member 103*b* has such a resiliency as to be deformable when walking. For example, the heel configuration forming member may be of a foam material. In this case, the resiliency of the foam material can be adjusted by changing the foaming rate.

A boundary between the heel body 103*a* and the heel configuration forming member 103*b*, i.e., a rear bottom end 103*c* of the heel body 103*a*. is substantially set at a position which is spaced apart from the axis of the tibia bone by a distance d. This distance d is determined to assure a comfortable walking to the wearer in consideration of relationships between the bone and muscular construction of foot of the wearer and foot landing in walking. This comfortable walking distance d does not greatly change with a change in heel height. However, the rear end of the heel bone projects more rearward as the height of heel increases.

Accordingly, a shoe which is provided with a higher heel having the rear bottom end set under the rear end of the heel bone will cause the heel rear bottom end to be far rearward from the comfortable walking distance d, and consequently involves uneasy walking. To the contrary, a shoe which is provided with a higher heel having the rear bottom end set at a position spaced apart from the axis of the tibia bone by the comfortable walking distance d will inevitably reveal that the shoe is a higher heel shoe.

In view thereof, in this embodiment, not only is set the rear bottom end of the heel body 103*a* at the position apart from the axis of the tibia bone by the comfortable walking distance d to assure easy walking, but also is provided the heel configuration forming member 103*b* behind the heel body 103*a* to impart a normal heel appearance to the heel portion 103.

The insert member 106 of the inner member is attached on the top surface of the inner sole 108. A rearward portion 107 of the insert member 106 is formed so as to be slightly higher than a forward portion of the insert member 106. Further, the deceptive elevating member 1 is placed on the rearward portion 107 of the insert member 106.

Figure 3:
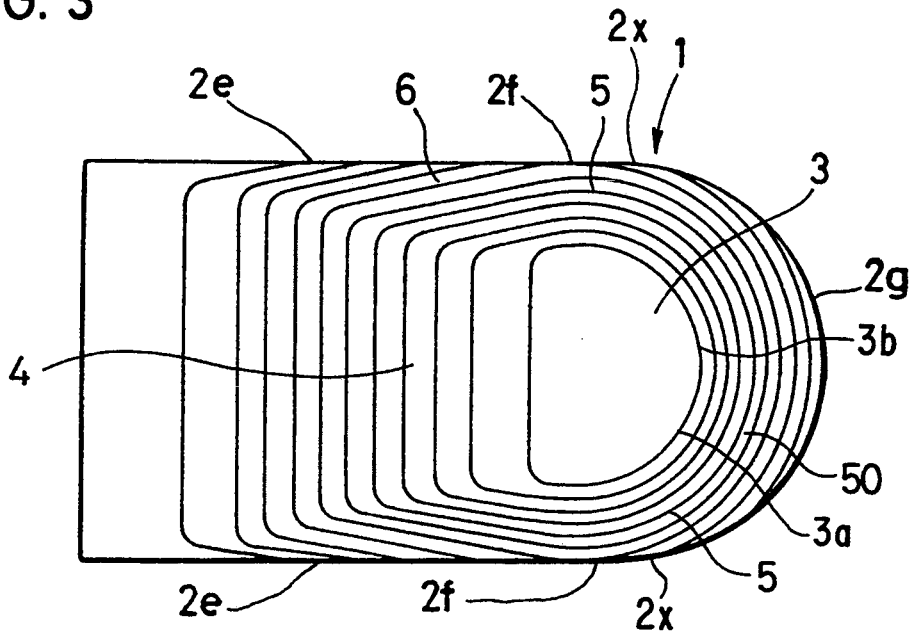
FIG. 3 is a diagram showing an shape of a top portion of an elevating member.
Figure 4:
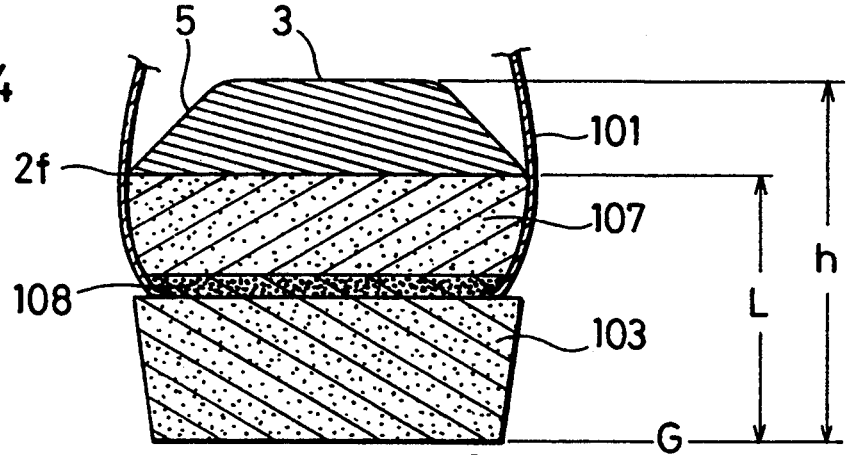
FIG. 4 is a view in a section taken along the line IV—IV in FIG. 2.
Figure 5:
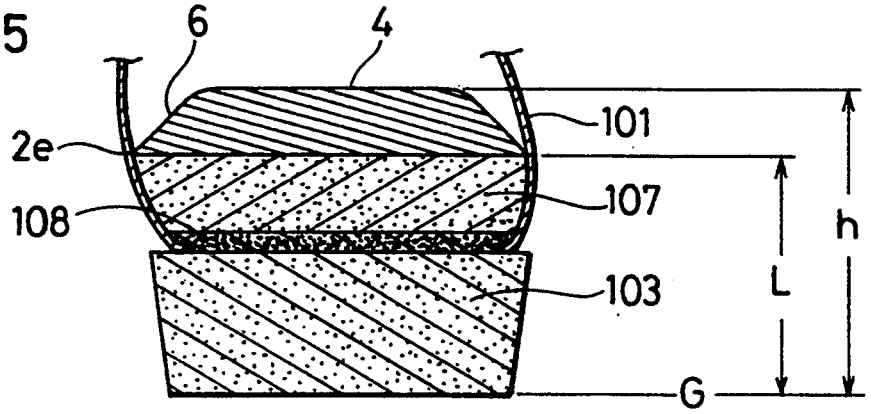
FIG. 5 is a view ill a section taken along the line V—V in FIG. 2.

FIG. 3 is a top plan view of the deceptive elevating member 1. A top profile of the deceptive elevating member is represented by contour lines. FIG. 4 is a sectional view taken along the line IV—IV in FIG. 2, and FIG. 5 is a sectional view taken along the line V—V in FIG. 2. As shown in FIGS. 2 to 5, the deceptive elevating member is formed with a top portion 3, slope portions 4, 5, 6, and 50 extending from the top portion 3.

The top portion 3 is positioned at a highest level of the deceptive elevating member 1. The slope portions 4, 5, 6, and 50 extend from the top portion 3 to peripheral edges of the deceptive elevating member 1. The top portion 3 is formed with a substantially flat surface in the form of a semicircle. The top portion 3 has an area sufficient to support a heel portion of foot of the wearer. The top portion 3 is connected to the slope portions 4, 5, 6, and 50 with an identical color to one another. The top portion 3 is smoothly connected to the slope portions 4, 5, 6, and 50 with a substantially continuous gradient. Accordingly, the third person will deceptively perceive the top and slope portions 3, 4, 5, 6, and 50 are a continuous flat surface. Also, it may be preferable to provide the top and slope portions 3, 4, 5, 6, and 50 with a color different from that of the inner surface of the upper 101 to enhance this deceptive effect. The top portion 3 has a rear arcuate border 3*a* connected to the slope portion 50. The rear arcuate border 3*a* has a rearmost end 3*b*. The previously described rear bottom end 103*c* of the heel body 103*a* is disposed forwardly of the rearmost end 3*b* of the rear arcuate border 3*a* as shown in FIGS. 1 and 2.

The slope portion 4 forward of the top portion 3 has a smaller inclination with respect to a horizontal plane, and flares in a descending direction as shown in FIGS. 2 and 3.

The slope portions 6 on the opposite sides of the slope portion 4 each have, as shown in FIGS. 3 and 5, an inclination slightly greater than the slope portion 4. The side slope portions 6 each have a peripheral edge 2*e* which comes into contact with an inner surface of a side portion of the upper 101.

Also, a shank portion of the insert member 106 is formed so as to have a width greater than that of a shank portion of normal shoes. This is because the distance between the opposite peripheral edges 2*e* is increased so wide as to ensure the necessary small inclination of the slope portion 6.

The slope portions 5 on the opposite sides of the top surface 3 each have, as shown in FIGS. 3 and 4, an inclination generally identical to the inclination of the slope portion 6. The slope portions 5 each have a peripheral edge 2*f* which comes into contact with an inner surface of the side portion of the upper 101.

The slope portion 50 on a rear side of the top portion 3 has an inclination generally identical to the inclination of the slope portion 6. The slope portion 50 has a semicircular peripheral edge 2*g* which comes into contact with an inner surface of a rear portion of the upper 101. The peripheral edges 2*f* meet the semicircular peripheral edge 2*g* at the positions 2*x* shown in FIG. 3. The slope portions 5 and 50 combinedly form a hemiconical surface.

As shown in FIGS. 1, 2, and 3, the peripheral edges 2*e* of the slope portions 6 gradually descends in a forward direction of the shoe. The peripheral edge 2*g* gradually descends in a rearward direction of the shoe from the positions 2*x*, and becomes lowest at a rearmost 101*r* of the upper 101. The peripheral edges 2*f* are at a highest level. These descending forms of the peripheral edges 2*e*, 2*f*, and 2*g* are made for the following reasons.

From the viewpoint of providing the deceptive appearance that the surface of the deceptive elevating member 1 is flat, it is preferable that the respective inclination angles of the slope portions 4, 5, 6, and 50 are made as small as possible. Also, from the viewpoint of providing the deceptive appearance that the depth of the upper 101 is great, in other words, that there is not provided any inner elevating member within the upper 101, it is preferable that the difference between the height of the peripheral edges and the height of the top portion 3 is made as great as possible.

Accordingly, an rearward portion 107 of the insert member 106 is formed so as to have an generally inverted trapezoid section as shown FIG. 4 which has wider width at an upper portion than at a lower portion. The rearward portion 107 has at an uppermost portion thereof a width which is wider than the inner sole 108 and is sufficient to ensure the necessary inclination of the slope portions 5 to provide the deceptive appearance that the surface of the deceptive elevating member 1 is flat. In other words, the greater the width of the upper surface of the insert member 106 is made, the greater the distance between the periphery edges *2f* of the opposite side slope portions 5 can be made. Accordingly, an increased difference can be made between the height h of the top portion 3 and the height L of the peripheral edge *2f* while ensuring the necessary small inclination angle of the slope portions 5 and 6 to provide the deceptive appearance that the surface of the deceptive elevating member 1 is flat.

With a rearward portion of this shoe, also, a rearmost portion 101*r* of the upper 101 is positioned rearward as far as possible. Accordingly, the height difference can be increased while assuring the small inclination angle necessary to provide the deceptive appearance that the surface of the deceptive elevating member 1 is flat.

Further, the fact has been known that there is a considerably great space between the inner surface of the upper of a shoe and an underside surface of foot of the wearer, particularly between a rear portion of the upper inner surface of the upper 101 and a rear portion of the foot underside surface. Accordingly, in this embodiment, the top portion 3 is reduced to a minimum area to support the heel bone to increase the height difference between the top portion and the peripheral edges *2e, 2f,* and *2g* while ensuring the necessary small inclination of the slope portions 6, 5, 50.

Further, the slope portions 5 and 50 are formed to be substantially straight so that the peripheral edge *2e, 2f,*and *2g* of the deceptive elevating member 1 can be clearly seen from the above. If the slope portions 5 and 50 are formed to be convex, the peripheral edges *2e, 2f,* and *2g* are hindered from being seen from the above, which will consequently impair the deceptive appearance of non-elevating member.

With thus constructed elevating shoe, when being put on, the shoe body 100 can keep the deceptive elevating structure from being perceived by the third person because of the fact that the shoe 100 is provided with the normally-shaped heel portion 103. On the other hand, in the shoe body 100 is provided the deceptive elevating member 1 having a height sufficient to raise the height of the wearer. Accordingly, the wearer can enjoy the raised height without the likelihood that the deceptive elevating structure would be perceived by the third person.

Also, the heel portion 103 includes the heel body 103*a* whose rear bottom end is set at the position spaced apart from the axis of the tibia bone by the comfortable walking distance d, and the heel configuration forming member 103*b* made of a resilient material. Accordingly, the wearer can enjoy comfortable and easy walking.

On the other hand, when the shoe is taken off, the inside of the shoe is exposed to the third person. However, the top portion 3 and the slope portions 4, 5, 6, and 50 are connected to one another with the substantially continuous gradient and with the identical color. Accordingly, this construction can render the third person deceptively perceive that the top portion 3 is flush with the slope portions 4, 5, 6, and 50, i.e., that the deceptive elevating member 1 is flat. Further, this construction can render the third person deceptively perceive that the height of the top portion 3 is the same level as that of the peripheral edges *2e, 2f,* and *2g.* Further, the color of the surfaces 3, 4, 5, 6, and 50 of the deceptive elevating member 1 is different from that of the inner surface of the upper 101. This makes the boundary line of the deceptive elevating member 1 and the upper 101 much clearer, and thus enhances the deceptive effect that the height of the top portion 3 is the height of the peripheral edges *2e, 2f,* and *2g.* Accordingly, the lower the peripheral edges *2e, 2f,* and *2g* is positioned, the lower the height of the top portion 3 can be perceived. Thus, there can be eliminated the likelihood that the deceptive inner elevating structure would be seen by the third person when being taken off.

It will be apparent that to enhance the above-mentioned deceptive effect that any inner elevating construction is provided in the shoe, it is preferable to provide a clear contrast between the deceptive elevating member 1 and the inner surface of the upper 101 in material, color, etc. Accordingly, it may be appropriate to provide the deceptive elevating member 1, or the inner surface of the upper 101, or both the deceptive elevating member 1 and the inner surface of the upper 101 near the boundary between the peripheral edges *2e, 2f,* and *2g* and the inner surface of the upper 101 with a thin line of contrasting portion defined by color different from those of the deceptive inner member and the inner surface of the upper 101, preferably, a thin line of darker color or lighter color. Also, it may be appropriate to provide a thin line of rugged surface near the boundary between the peripheral edges *2e, 2f,* and *2g* and the inner surface of the upper 101. Further, it may be appropriate to place an insert member having a color different from that of the inner surface of the upper 101 and place on the insert member a deceptive elevating member whose peripheral edges are cut off thinly so that a thin line of the different color of the insert member can be exposed to people. Such thin line will attract the eyes of people more keenly than the other portions of the deceptive elevating member 1 to enhance the deceptive effect.

Although the deceptive elevating member 1 is placed on the insert member 106 having the raised portion in the foregoing embodiment, it may be appropriate to provide an insert member having a uniform height, or provide an deceptive elevating member integral with an insert member, or inner sole.

Although the present invention has been fully described by way of example with reference to the drawings, it is to be understood that various changes and modifications will be apparent to those skilled in the art. Therefore, unless otherwise such changes and modifications depart from the scope of the invention, they should be construed as being included therein.

What is claimed is:

1. An elevating shoe comprising a shoe body having an upper, a sole and a heel, and deceptive elevating means for elevating the heel of a person wearing the shoe comprising a deceptive resilient elevating member having a heel-bearing top surface on which the heel of a person wearing the shoes bears, said heel-bearing top surface having a rear arcuate border and two side borders, said rear arcuate border having a rearmost end, said deceptive elevating member having a rising surface having an outer peripheral edge juxtaposed to said shoe body, said rising surface extending upwardly from said outer peripheral edge to said heel-bearing top surface with a substantially straight gradient, said outer peripheral edge having a rear arcuate portion and two side portions, said rising surface having a rear part which extends upwardly from said rear arcuate portion of said peripheral edge to said rear arcuate border of said heel-bearing top surface, said rising surface having two side parts which extend upwardly from said two side edge portions of said peripheral edge to said respective two side borders of said heel-bearing top surface, said heel-bearing top surface having a front end, said deceptive elevating member having a forward sloping section extending forwardly of said front end, said forward sloping section sloping downwardly and forwardly from said front end, said rising surface further including two forward parts disposed forwardly of the respective side parts of said rising surface, said peripheral edge having two forward portions disposed forwardly of the respective side portions of said peripheral edge, said two forward parts of said rising surface extending with a substantially straight gradient from said respective two forward portions of said peripheral edge to said forward sloping section of said deceptive elevating member, said two forward parts of said rising surface having a substantially straight gradient and having a slope angle which is the same as the slope angle of said arcuate rear part and the same as the two side parts of said rising surface, said peripheral edge having a rearmost point and two intermediate points where the rear arcuate portion joins the respective two side portions, said peripheral edge sloping downwardly and rearwardly from said intermediate points to said rearmost point, said heel comprising a heel body for supporting the wearer, said heel body having a rear end which is positioned forwardly of said rearmost end of said rear arcuate border of said heel-bearing top surface of said deceptive elevating member.

2. An elevating shoe according to claim 1 wherein said forward sloping section slopes downwardly at a gradient angle which is less than said slope angle.

3. An elevating shoe according to claim 1 wherein said peripheral edge slopes downwardly as said peripheral edge extends forwardly from said intermediate points.

4.An elevating shoe according to claim 1 wherein said sole comprises an outer sole, an inner sole and an insert member, said insert member being disposed between said inner sole and said deceptive elevating member, said insert member having a rear insert part underlying said heel-bearing top surface, said rear insert part having an outer peripheral edge which is substantially coincident with said outer peripheral edge of said rising surface.

5. An elevating shoe according to claim 1 wherein said sole comprises an outer sole, an inner sole and an insert member, said insert member being disposed between said inner sole and said deceptive elevating member, said insert member having an intermediate insert part underlying said forward sloping part of said deceptive elevating member, said intermediate insert part having an outer peripheral edge which is substantially coincident with said outer peripheral edge of said rising surface.

6. An elevating shoe according to claim 1 wherein the color of said rising surface is different than the color of the inner surface of said shoe body.

7. An elevating shoe according to claim 1 wherein a thin line of contrasting color is provided at said peripheral edge.

8. An elevating shoe according to claim 1 wherein a thin line of a rugged surface is provided at said peripheral edge.

9. An elevating shoe according to claim 1 wherein said rear arcuate part of said rising surface defines a substantially hemiconical surface.

10. An elevating shoe according to claim 1 wherein said deceptive elevating member has a generally trapezoidal cross-sectional configuration.

11. An elevating shoe according to claim 4 wherein said rear insert part has a top surface and a bottom surface, said top surface being wider than said bottom surface.

12. An elevating shoe according to claim 5 wherein said intermediate insert part has a generally inverted trapezoidal configuration.

13. An elevating shoe according to claim 1 wherein a longitudinal vertical cutting plane which bisects said shoe intersects said rear part of said rising surface along a substantially straight line, said straight line corresponding to said straight gradient.

14. An elevating shoe according to claim 1 wherein each of said two side parts of said rising surface are substantially planar.

15. An elevating shoe according to claim 1 wherein each of said two side parts of said rising surface are substantially non-convex.

16. An elevating shoe according to claim 1 wherein said deceptive elevating member has a substantially trapezoidal cross-sectional configuration taken traversely through said heel-bearing top surface with the side of the trapezoid defined by the heel-bearing top surface being the shorter of the two parallel sides of the trapezoid.

17. An elevating shoe according to claim 16 wherein said rising surface defines the two non-parallel sides of the trapezoid.

18. An elevating shoe according to claim 1 wherein said deceptive elevating member has a bottom surface, said deceptive elevating member having a substantially trapezoidal cross-sectional configuration taken traversely through said heel with said heel-bearing top surface defining the shorter of the two parallel sides of the trapezoid and with said bottom surface defining the longer of the two parallel sides of the trapezoid, the rising surface on opposite sides of the heel defining the two non-parallel sides of the trapezoid.

19. An elevating shoe according to claim 1 wherein said deceptive elevating member has a substantially trapezoidal cross-sectional configuration taken traversely through said forward sloping section with the side of the trapezoid defined by the forward sloping section being the shorter of the two parallel sides of the trapezoid.

20. An elevating shoe according to claim 1 wherein said deceptive member has a bottom surface, said bottom surface having an outer peripheral edge which is substantially coincident with said outer peripheral edge of said rising surface.

21. An elevating shoe according to claim 1 wherein said deceptive member has a bottom surface, said bottom surface having an outer peripheral edge having a rear arcuate section substantially coincident with said rear arcuate portion of said outer peripheral edge of said rising surface and having two side sections substantially coincident with said two side portions of said outer peripheral edge of said rising surface, such that said outer peripheral edge of said rising surface terminates substantially at said outer peripheral edge of said bottom surface of said deceptive member.

22. An elevating shoe according to claim 1 wherein said deceptive elevating means further comprises an insert member underlying said deceptive elevating member, said deceptive elevating member having a bottom surface, said insert member having a top surface abutting said bottom surface of said deceptive elevating member, said upper surface of said insert member having an outer peripheral edge having a rear arcuate section substantially coincident with said rear arcuate portion of said outer peripheral edge of said rising surface and having two side sections substantially coincident with said two side portions of said outer peripheral edge of said rising surface.

23. An elevating shoe according to claim 22 wherein said insert member decreases in thickness as the front of the shoe is approached.

24. An elevating shoe comprising a shoe body having an upper, a sole and a heel, a deceptive elevating member in the shoe body for elevating the height of the wearer, said deceptive elevating member having a heel-bearing top surface on which the heel of a person wearing the shoes bears, said heel-bearing top surface having a rear arcuate border and two side borders, said rear arcuate border having a rearmost end, said deceptive elevating member having a rising surface having an outer peripheral edge juxtaposed to said shoe body, said rising surface extending upwardly from said outer peripheral edge to said heel-bearing top surface with a substantially continuous gradient, said outer peripheral edge having a rear arcuate portion and two side portions, said rising surface having a rear part which extends upwardly from said rear arcuate portion of said peripheral edge to said rear arcuate border of said heel-bearing top surface, said rising surface having two side parts which extend upwardly from said two side edge portions of said peripheral edge to said respective two side borders of said heel-bearing top surface, said peripheral edge having a rearmost point and two intermediate points where the rear arcuate portion joins the respective two side portions, said peripheral edge sloping downwardly and rearwardly from said intermediate points to said rearmost point, said heel comprising a heel body for supporting the wearer, said heel body having a rear end which is positioned forwardly of said rearmost end of said rear arcuate border of said heel-bearing top surface of said deceptive elevating member.

* * * * *